US005319717A

United States Patent [19]

Holesha

[11] Patent Number: 5,319,717

[45] Date of Patent: Jun. 7, 1994

[54] HEARING AID MICROPHONE WITH MODIFIED HIGH-FREQUENCY RESPONSE

[75] Inventor: Kenneth G. Holesha, Marengo, Ill.

[73] Assignee: Knowles Electronics, Inc., Itasca, Ill.

[21] Appl. No.: 959,710

[22] Filed: Oct. 13, 1992

[51] Int. Cl.[5] ..... H04R 25/00

[52] U.S. Cl. ..... 381/168; 381/69; 381/169

[58] Field of Search ..... 381/68, 69, 158, 159, 381/153, 168, 169, 68.6; 181/129, 158, 161, 130

[56] References Cited

U.S. PATENT DOCUMENTS

| | | | |
|---|---|---|---|
| 3,560,667 | 2/1971 | Carlson | 381/200 |
| 4,189,627 | 2/1980 | Flanagan | 381/158 |
| 4,815,138 | 3/1989 | Diethelm | 381/68.6 |
| 4,837,833 | 6/1989 | Madaffari | 381/69 |
| 4,870,688 | 9/1989 | Voroba et al. | 381/68.6 |

*Primary Examiner*—Curtis Kuntz
*Assistant Examiner*—Huyen D. Le
*Attorney, Agent, or Firm*—Wallenstein, Wagner & Hattis, Ltd.

[57] ABSTRACT

A microphone for a hearing aid having a modified high frequency response is disclosed. The hearing aid comprises a hollow housing having an upper wall, a lower wall and a depending wall disposed between the upper wall and the lower wall. The upper, lower and depending walls define a main chamber. The microphone further comprises an inlet tube extending outwardly from the depending wall for receiving sound and a diaphragm in continuous peripheral contact with the depending wall for substantially entirely dividing the main chamber into an input chamber in communicating relationship with the inlet tube and an output chamber. The input chamber presents an effective inertance to sound entering via the inlet tube. A structure is disposed within the input chamber between the diaphragm and the upper wall forming an elongated sound path. The elongated sound path increases the effective inertance of the input chamber to thereby lower the frequency of the peak response of the microphone to a frequency lower than the frequency of the peak response of a conventional receiver coupled thereto, to eliminate high frequency oscillations.

19 Claims, 2 Drawing Sheets

HEARING AID MICROPHONE WITH MODIFIED HIGH-FREQUENCY RESPONSE

DESCRIPTION

1. Technical Field

The invention relates to a microphone for a hearing aid having a modified high frequency response to eliminate possible high-frequency oscillations when coupled to a hearing aid receiver.

2. Background Prior Art

A hearing aid typically comprises a microphone and a receiver. The microphone receives sound and converts the received sound to an electrical signal. The receiver takes the electrical signal, amplifies it, and converts the amplified electrical signal to sound.

As a result of various factors, including the inertance of air within the microphone, conventional microphones have a response curve having a peak generally around 4.8–5.0 kHz. Similarly, conventional receivers also have a response curve having a similar peak. When one of these microphones is coupled to one of these receivers, the resulting closed loop gain can result in high frequency oscillations, due to sound leaking back from the receiver to the microphone. These oscillations are quite annoying and result in a relatively large percentage of hearing aids being returned.

It is known that by increasing the inertance presented to sound entering the microphone, the frequency of the peak response of the microphone can be reduced to a frequency significantly lower than that of the receiver coupled thereto. While this would reduce the high frequency performance of the hearing aid, hearing aid manufacturers have indicated a willingness to accept this reduction as a tradeoff for reduced high-frequency oscillations.

Tibbet Industries sells a Series 125 microphone comprising a generally cylindrical microphone housing having opposing ends and an inlet port disposed through one of the ends. Tibbet has recently introduced a microphone having an inlet tube extending radially from the end having the inlet port. It is believed that this tube was provided to prevent dirt or other foreign substances from entering the microphone via the inlet port, and thereby damaging the diaphragm. However, the elongated tube also has the effect of increasing the inertance presented to the air as it travels to the diaphragm, thereby lowering the frequency of the peak response of the microphone. However, this microphone construction has been found to be difficult to assemble within a hearing aid.

Knowles Electronics, the assignee of this patent application, has previously developed a microphone having selective inertance, which is disclosed in Madaffari, U.S. Pat. No. 4,837,833. This microphone had a housing and a diaphragm extending substantially across the housing and defining an input chamber coupled to an input tube and an output chamber. The diaphragm had a notch cut through the diaphragm at the rear of the microphone, the notch forming a by-pass port. A C-shaped plate having a central recess was disposed in the input chamber between the diaphragm and the housing. The central recess was directed toward the input port. The C-shaped plate formed generally narrow channels leading back to the by-pass port. The narrow channels would generally pass low frequency sound to the backside of the diaphragm, so that low frequency sound would not cause the diaphragm to vibrate. The narrow channels, on the other hand, would block intermediate and high frequency sound from passing through the by-pass port, so that such frequencies would cause the diaphragm to vibrate. This microphone resulted in a high frequency emphasis microphone which provided a steeply rising frequency response. However, this microphone would not reduce the frequency of the peak response of the microphone.

The present invention is provided to solve these and other problems.

SUMMARY OF THE INVENTION

It is an object of the invention to provide a microphone for a hearing aid having a modified high frequency response to reduce or eliminate high frequency oscillation when coupled to a receiver.

In accordance with the invention, the microphone comprises a hollow housing defining a main chamber with an inlet tube extending outwardly from the housing for receiving sound. A diaphragm is disposed within the housing to entirely divide the main chamber into an input chamber in communicating relationship with the inlet tube and an outlet chamber. The input chamber presents an effective inertance to sound entering the front chamber via the inlet tube. Means are disposed within the input chamber for increasing the effective inertance of the input chamber.

According to a first embodiment, the inertance increasing means comprises a generally C-shaped plate parallel to the diaphragm and having a central recess. The radial orientation, as well as the detailed size and shape, of the plate, and hence of the central recess, can be varied at the time of manufacture to vary the inertance, and thus the frequency response, of the microphone.

According to a second embodiment, the inertance increasing means comprises an embossment inwardly formed in the housing to provide a generally C-shaped structure parallel to the diaphragm and having a central recess. As with the first embodiment, the radial orientation of the embossments, and hence of the central recess, can be varied at the time of manufacture to vary the inertance, and thus the frequency response, of the microphone. An added advantage of this design is that one can view the orientation of the embossments from the outside of the housing, thus indicating the orientation, and thus the frequency response, of the microphone.

Other features and advantages of the invention will be apparent from the following specification taken in conjunction with the following drawing.

DETAILED DESCRIPTION

Figure 1:
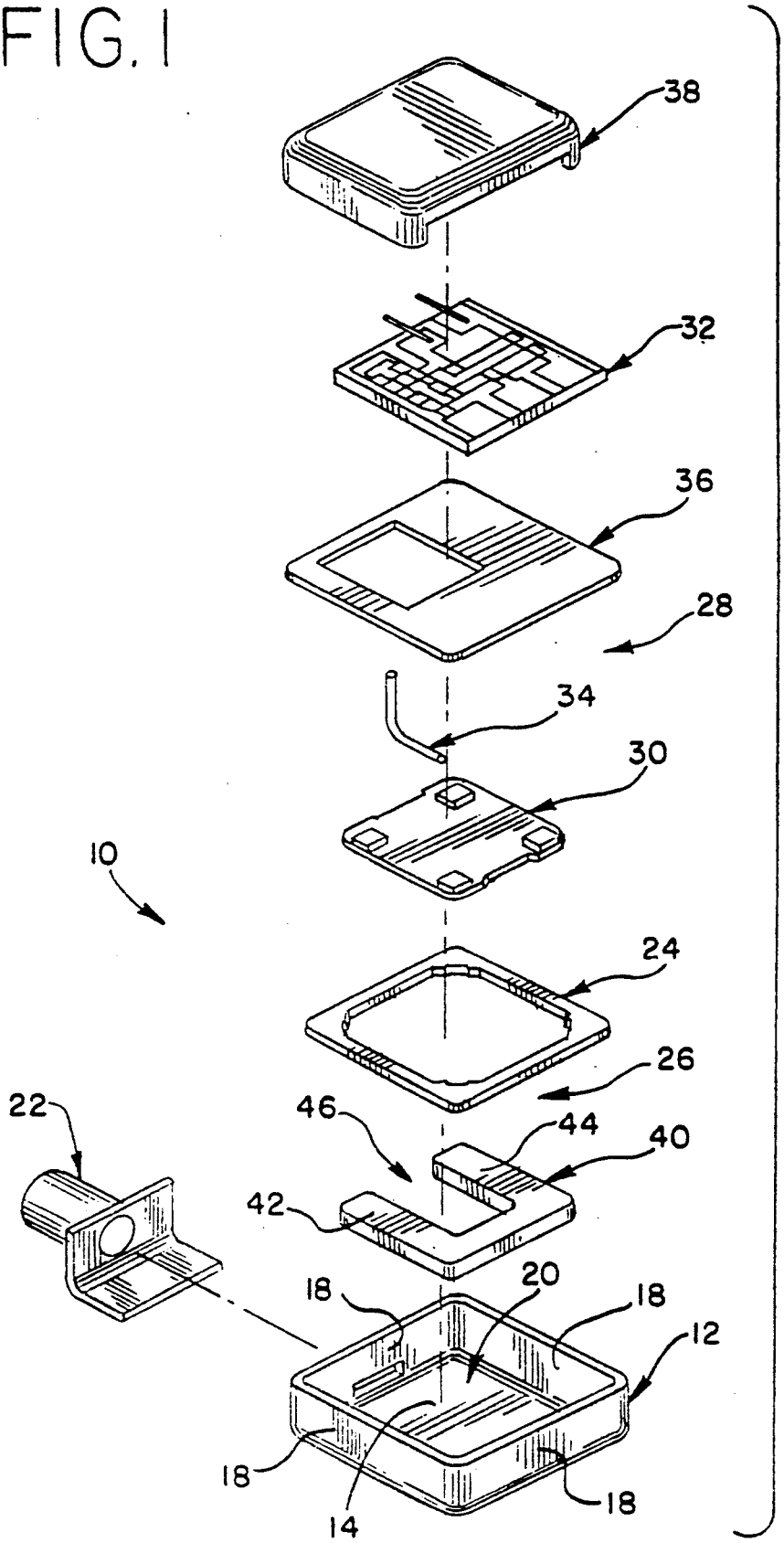
FIG. 1 is an exploded view of a microphone in accordance with a first embodiment of the invention.

While this invention is susceptible of embodiments in many different forms, there is shown in the drawings and will herein be described in detail, preferred embodiments of the invention with the understanding that the present disclosure is to be considered as exemplifications of the principles of the invention and is not intended to limit the broad aspects of the invention to the embodiments illustrated.

A first embodiment of a microphone 10 for a hearing aid is illustrated in FIG. 1. The microphone 10 has a modified high frequency response wherein the frequency of the peak response of the microphone is reduced to a frequency lower than the frequency of the peak response of a conventional receiver to which the microphone 10 is ultimately connected.

The microphone 10 comprises a generally hollow cup 12 having a base wall 14 and four side walls 18. The base and side walls 14, 18, respectively, define a main chamber 20.

An inlet tube 22 extends outwardly from one of the side walls 18 for receiving sound and communicating the received sound into the main chamber 20. A diaphragm, generally designated 24, comprises a conventional ring and film assembly is spaced from the base wall 14 and is placed in continuous peripheral contact with the side wall 18. The diaphragm entirely acoustically divides the main chamber into an input chamber 26 which is in communicating relationship with the inlet tube 22, and an output chamber 28. The diaphragm 24 includes a tiny vent opening, of the order of 0.002", to equalize pressure between the input and output chambers 26, 28.

As is well known, the inlet tube 22 and the input chamber 26 present an effective inertance to sound entering the microphone 10. A charged plate 30 is conventionally disposed in contact with the diaphragm 24. The charged plate 30 is coupled to a circuit board 32 by a wire 34 extending through an opening in a plate 36. A cap 38 is secured to the cup 12 to form a microphone housing. As is well known, sound entering the input chamber 26 via the inlet tube 22 causes the diaphragm 24 to vibrate, which vibration is detected by the charged plate 30, developing an electrical signal which is transmitted to the circuit board 32 via the wire 34. The circuit board 32 contains electronic circuitry, not specifically shown, as is well known.

In accordance with the invention, a structure such as a C-shaped plate 40, is disposed within the input chamber 26 between, and in contact with, the diaphragm 24 and the base wall 14. The C-shaped plate 40 is secured to the base wall 14 by spot welding and abuts the diaphragm 24.

The C-shaped plate 40 has parallel arms 42, 44 defining a recess 46. The C-shaped plate 40 has a width W of 0.101", ±0.001, a length L of 0.091", ±0.001, and the recess 46 has a width W' of 0.05".

The recess 46, as well as channels formed between the parallel arms 42, 44, and adjacent ones of the side walls 18 form elongated sound paths through which received sound must pass. The elongated sound paths increase the effective inertance of the input chamber, thereby reducing the frequency of the peak of the response curve. By horizontally rotating the C-shaped plate, the effective inertance of the input chamber 26 can be adjusted, thereby adjusting the frequency of the peak of the response curve as desired. For example, the C-shaped plate could be adjusted a full 90 degrees, or more.

It has been found that the frequency of the peak of the microphone's response curve has been reduced from 5.5 kHz to 4.5 kHz by the addition of the C-shaped plate 40 with the recess 46 oriented towards the inlet tube 22.

Figure 2:
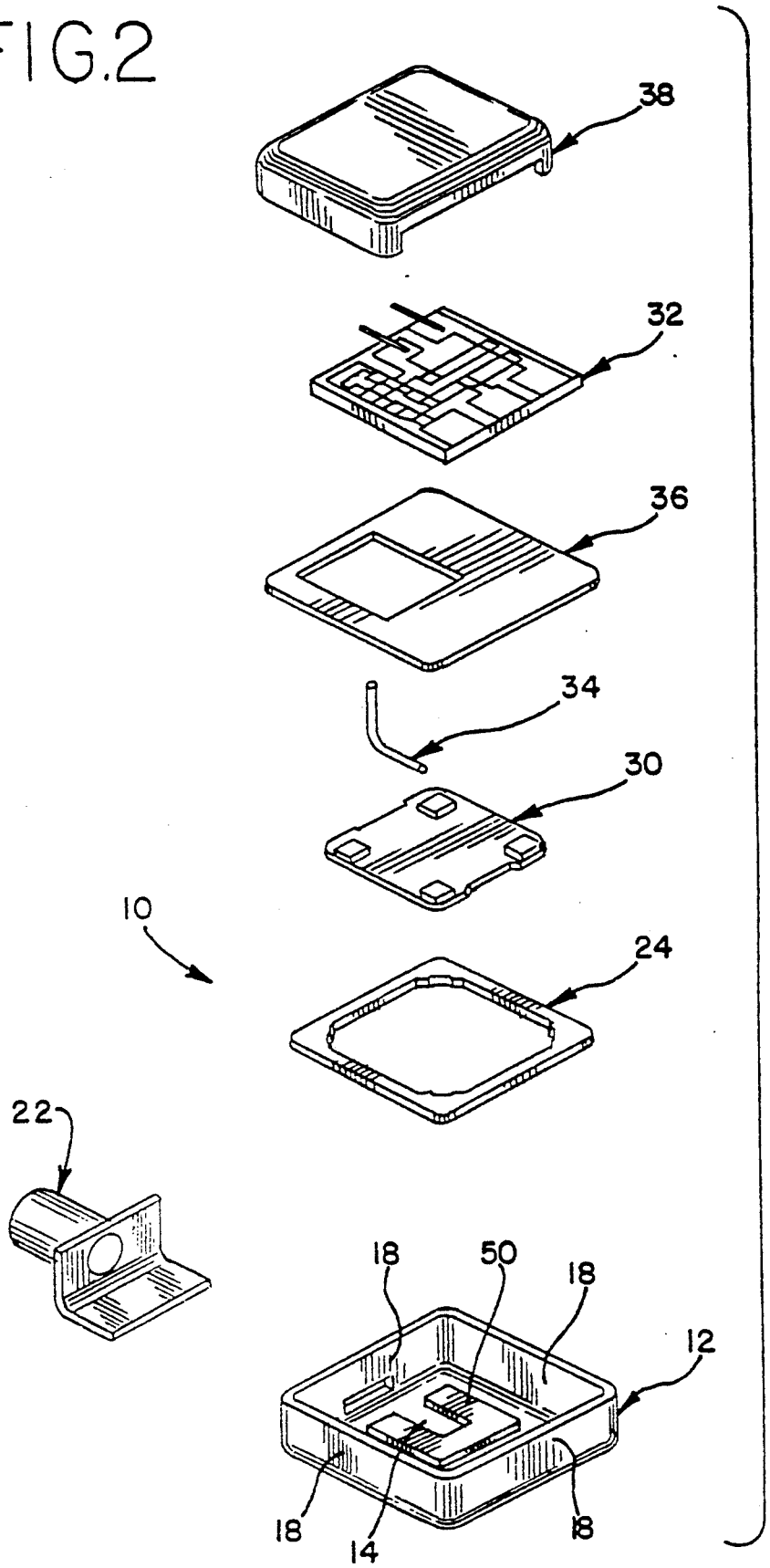
FIG. 2 is an exploded view of a microphone in accordance with a second embodiment of the invention.

A second embodiment of the invention is shown in FIG. 2. This embodiment is substantially the same as the first embodiment, except that the C-shaped plate 40 has been replaced by an inwardly directed, C-shaped embossment 50. As with the first embodiment, the horizontal orientation of the embossment 50 can be adjusted, thereby adjusting the frequency of the peak of the response curve as desired.

This embodiment has an economic advantage over the first embodiment through a reduced piece count. Additionally, the rotational orientation of the C-shaped embossment 50 will appear on the outer surface 14 as a C-shaped groove. Thus one can recognize the frequency characteristic of a particular microphone by simple inspection of the outer surface **14*a* of the base wall 14**.

It will be understood that the invention may be embodied in other specific forms without departing from the spirit or central characteristics thereof. For example, structures of shapes other than C-shaped can be substituted to provide an elongated sound path, such as U-shaped, W-shaped, E-shaped, M-shaped, N-shaped, T-shaped, or the like. The present examples and embodiments, therefore, are to be considered in all respects as illustrative and not restrictive, and the invention is not to be limited to the details given herein.

I claim:

1. A microphone having a modified high frequency response, the microphone comprising:

a hollow housing defining a main chamber;

an inlet tube extending outwardly from said housing for receiving sound;

a diaphragm disposed to entirely acoustically divide said main chamber into an input chamber and an output chamber, said input chamber being in communicating relationship with said inlet tube, and said input chamber presenting an effective inertance to sound entering via the inlet tube; and means disposed within said input chamber for increasing said effective inertance of said input chamber.

2. . The microphone of claim 1 wherein said inertance increasing means comprises a structure providing an elongated sound path.

3. The microphone of claim 2 wherein said structure is disposed generally parallel to said diaphragm.

4. The microphone of claim 3 wherein said structure comprises a generally C-shaped plate having a central recess.

5. The microphone of claim 4 wherein said central recess is directed generally towards said inlet tube.

6. The microphone of claim 4 wherein said central recess is directed generally 90 degrees from said inlet port.

7. The microphone of claim 2 wherein said structure comprises an embossment formed in said housing.

8. The microphone of claim 7 wherein said embossment is generally C-shaped and having a central recess.

9. The microphone of claim 8 wherein said central recess is directed generally towards said inlet tube.

10. The microphone of claim 8 wherein said central recess is directed generally 90 degrees from said inlet port.

11. A microphone having a modified high frequency response, the microphone comprising:

a hollow housing having a base wall, a cap end, and a depending wall disposed between said cap end and said base wall, said cap end, base and depending walls defining a main chamber;

an inlet tube extending outwardly from said depending wall or receiving sound;

a diaphragm in continuous peripheral contact with said depending wall for entirely acoustically dividing said main chamber into an input chamber and output chamber, said input chamber being in communication relationship with said inlet tue, and said input chamber presenting an effective inertance to sound entering via the inlet tube; and a structure having a central recess, the structure disposed within said input chamber between said diaphragm and said upper wall for increasing said effective inertance of said input chamber.

12. The microphone of claim 11 wherein said structure is generally C-shaped.

13. The microphone of claim 12 wherein said generally C-shaped structure comprises a generally C-shaped plate.

14. The microphone of claim 11 wherein said central recess is directed generally towards said inlet tube.

15. The microphone of claim 11 wherein said central recess is directed generally 90 degrees from said inlet port.

16. The microphone of claim 12 wherein said generally C-shaped structure comprises an embossment formed in said cap end.

17. A microphone having a modified high frequency response, the microphone comprising;

a hollow housing having a base wall, a cap end, and a depending wall disposed between said cap end and said base wall, said cap end, base and depending walls defining a main chamber;

an inlet tube extending outwardly from said depending wall for receiving sound;

a diaphragm in continuous peripheral contact with said depending wall for entirely acoustically dividing said main chamber into an input chamber and an output chamber, said input chamber being in communicating relationship with said inlet tube, and said input chamber presenting an effective inertance to sound entering via the inlet tube; and a structure disposed within said input chamber between said diaphragm and said cap end forming an elongated sound path, said elongated sound path contributing to increasing said effective inertance of said input chamber.

18. The microphone of claim 17 wherein said structure forms a plurality of sound paths.

19. The microphone of claim 17 wherein said structure is generally C-shaped having a recess operative as said elongated sound path.

* * * * *